US006484900B1

(12) United States Patent
Stiner et al.

(10) Patent No.: US 6,484,900 B1
(45) Date of Patent: Nov. 26, 2002

(54) TRANSPARENT FUEL CANISTER

(75) Inventors: Roy E. Stiner, Owasso, OK (US); Gary Benjamin, Bixby, OK (US)

(73) Assignee: W. C. Bradley Company, Columbus, GA (US)

( * ) Notice: Subject to any disclaimer, the term of this patent is extended or adjusted under 35 U.S.C. 154(b) by 0 days.

(21) Appl. No.: 09/487,021

(22) Filed: Jan. 19, 2000

(51) Int. Cl.[7] ..... B65D 5/00
(52) U.S. Cl. ..... 220/662; 220/581; 220/583
(58) Field of Search ..... 220/662, 581, 220/583

(56) References Cited

U.S. PATENT DOCUMENTS

| | | | | | |
|---|---|---|---|---|---|
| 1,527,204 | A | | 2/1925 | McCormick | |
| 2,093,575 | A | | 9/1937 | Roberts | |
| 3,176,880 | A | | 4/1965 | Archbold | |
| 3,368,591 | A | | 2/1968 | Zerbetto | |
| 3,505,870 | A | | 4/1970 | Smylie | |
| 3,662,780 | A | * | 5/1972 | Marsh | 220/581 X |
| 3,926,324 | A | * | 12/1975 | Zavasnik | 220/581 X |
| 4,213,536 | A | | 7/1980 | Hafner | |
| 4,286,632 | A | | 9/1981 | Abel | |
| 4,293,084 | A | | 10/1981 | Lussier | |
| 4,589,563 | A | * | 5/1986 | Born | 220/581 X |
| 4,819,833 | A | | 4/1989 | Huddleston et al. | |
| 4,948,016 | A | | 8/1990 | Summons et al. | |
| 4,971,224 | A | * | 11/1990 | Scremin | 220/583 X |
| 5,060,823 | A | | 10/1991 | Perlman | |
| 5,285,916 | A | * | 2/1994 | Ross | 220/581 X |
| 5,839,600 | A | * | 11/1998 | Moreira et al. | 220/581 X |
| 5,927,537 | A | * | 7/1999 | Falk et al. | 220/581 X |
| 6,065,630 | A | * | 5/2000 | Outwater | 220/662 X |

* cited by examiner

*Primary Examiner*—Steven Pollard
(74) *Attorney, Agent, or Firm*—James W. Kayden; Thomas, Kayden, Horstemeyer & Risley LLP

(57) ABSTRACT

A camping-type container for a liquified gas fuel. The inventive container comprises: a container body formed of a transparent material such that a user can see the liquid level of the liquified gas fuel in the container; a top end structure provided on the top end of the container body; and a discharge valve provided in the top end structure, the discharge valve being a valve of the type attachable to a camping-type appliance.

16 Claims, 4 Drawing Sheets

TRANSPARENT FUEL CANISTER

FIELD OF THE INVENTION

The present invention relates to containers for liquified gas fuels. More particularly, but not by way of limitation, the present invention relates to camp-type containers for liquified gas fuels.

BACKGROUND OF THE INVENTION

Portable gas stoves, lanterns, and other appliances used for camping, backpacking, etc. are typically fueled by butane, isobutane, propane, white gas, or other gas fuels stored in liquified form. Such fuels are commonly provided in metal, aerosol-type containers which can, in many cases, be attached directly to the camping appliance.

The metal camp-type containers used heretofore for storing liquified gas fuels provide good strength and durability for most camp-type uses. However, these metal containers are disadvantageous in that the user cannot see or otherwise quickly and conveniently determine how much fuel remains in the container. Although the user can, to some degree, roughly estimate the amount of fuel contained in the container by lifting and/or shaking the container, this method of estimation is not very accurate. Moreover, the lifting and shaking technique cannot be employed with any degree of reliability unless the container is first disconnected from the appliance.

Thus, a need presently exists for a camp-type canister for liquified gas fuels which (a) allows the user to quickly, easily, and accurately determine the amount of fuel remaining in the container and (b) provides substantially at least the same degree of strength and durability as the metal containers used heretofore.

SUMMARY OF THE INVENTION

The present invention provides a camping-type container which addresses the needs and alleviates the problems mentioned above. The inventive container comprises: a container body formed of a transparent material such that a user can see the liquid level of a liquified gas fuel stored in the container; a top end structure provided on the top end of the container body; and a discharge valve provided in the top end structure. The discharge valve is a valve of the type attachable to a camping-type appliance.

Further objects, features, and advantages of the present invention will be apparent upon examining the accompanying drawings and upon reading the following description of the preferred embodiments.

DETAILED DESCRIPTION OF THE PREFERRED EMBODIMENTS

Figure 1:
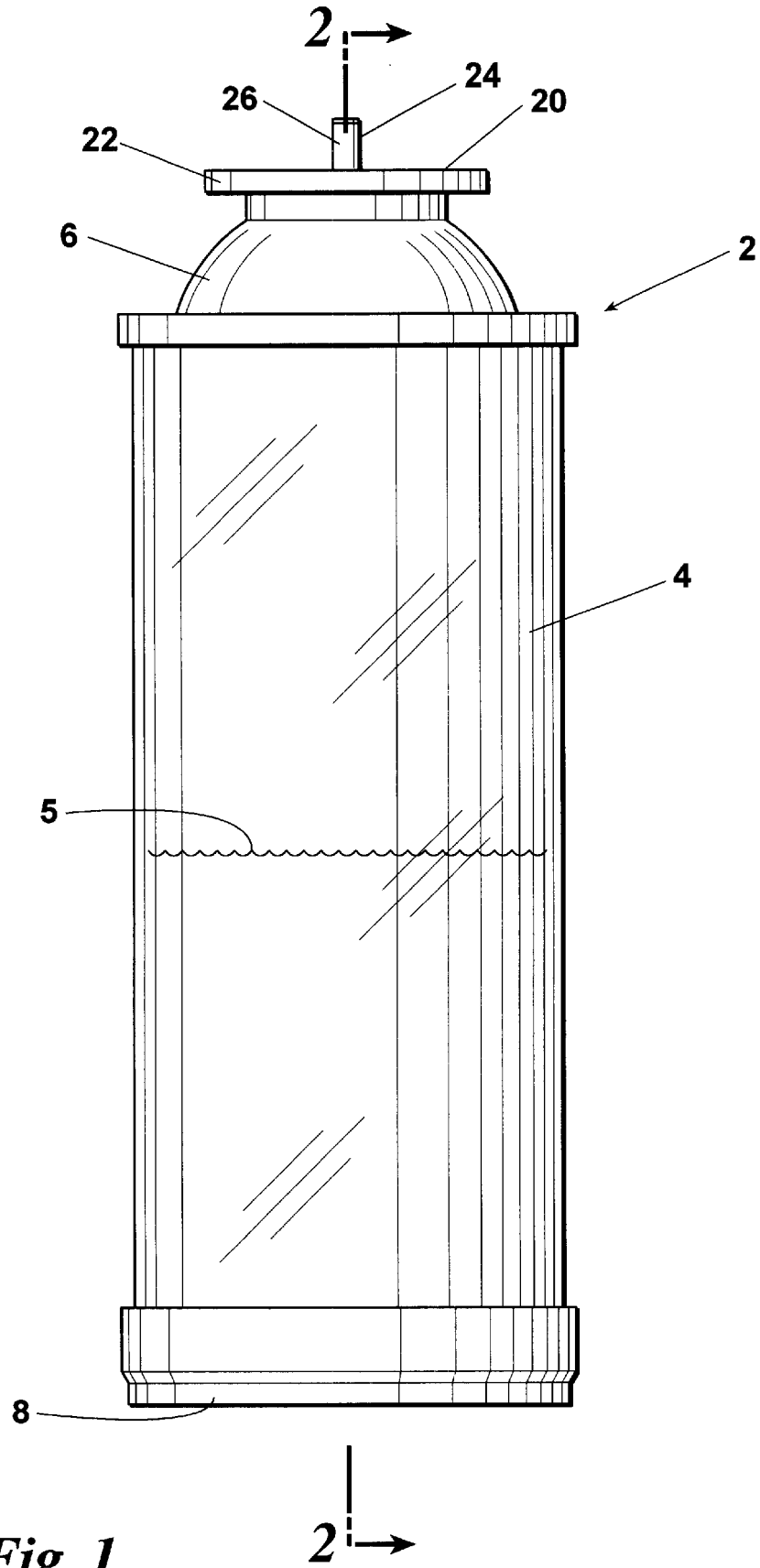
FIG. 1 provides an elevational view of an embodiment 2 of a camp-type fuel container provided by the present invention.
Figure 2:
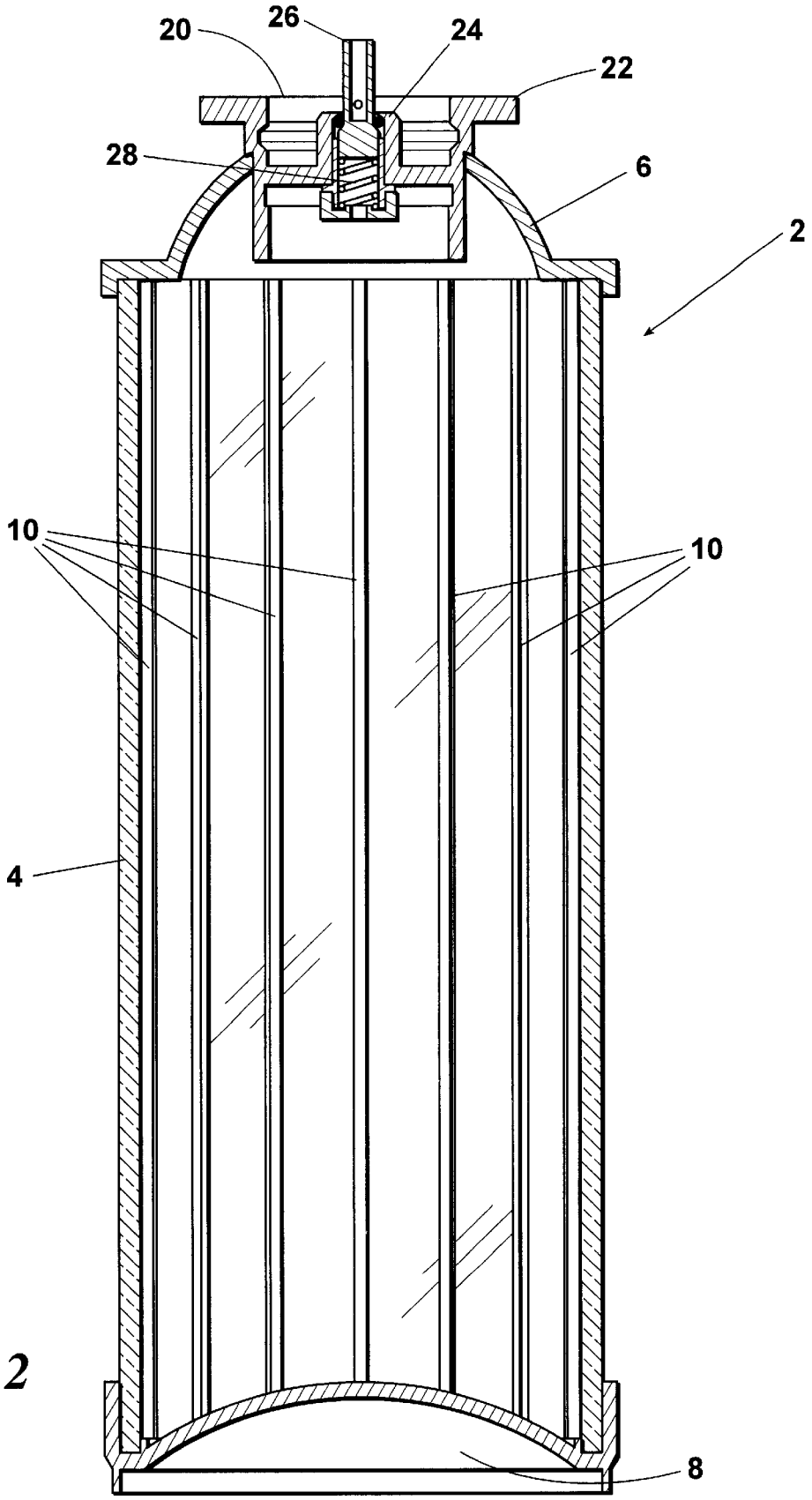
FIG. 2 provides a cutaway, elevational side view of container 2 as seen from perspective 2—2 shown in FIG. 1.

As will be understood by those skilled in the art, the camp-type container provided by the present invention can be of one piece or multiple piece (preferably two piece or three piece) design. A first embodiment 2 of the inventive container is depicted in FIGS. 1 and 2. Inventive container 2 is a three-piece container comprising: an elongate cylindrical body 4; a top dome 6; and a concave bottom piece 8.

Cylindrical body 4 is preferably formed from plastic or some other material which is transparent so that the liquid level 5 in container 2 is visible to the user. As used herein and in the claims, the term "transparent" includes and refers to structures which are transparent, clear, or translucent. The particular material employed in forming body 4 should be chemically inert with respect to the fuel stored within the container and should provide sufficient strength and durability for camping-type uses. Examples of suitable materials include, but are not limited to, plastics such as acrylonitrile butadiene styrene (ABS) and cellulose acetate butyrate (CAB).

Cylindrical body 4 can be formed by injection molding, extrusion, or generally any other technique used for forming products from materials of this type. Longitudinal ribs 10 can be provided along the interior or exterior of body 4 to provide extra strength and reduce the necessary thickness of the material required between ribs 10, thereby enhancing visibility.

Top dome 6 and bottom piece 8 can be metallic pieces of the type used heretofore on metal containers. Alternatively, top dome 8 and/or bottom piece 8 can be formed from the same type of material used to form body 4. Metallic domes and bottom pieces can be attached to plastic body structures by: crimping techniques of the type used heretofore for attaching metal domes to metal containers; insert molding; adhesion; or other techniques commonly used for attaching metal to plastic.

Figure 3:
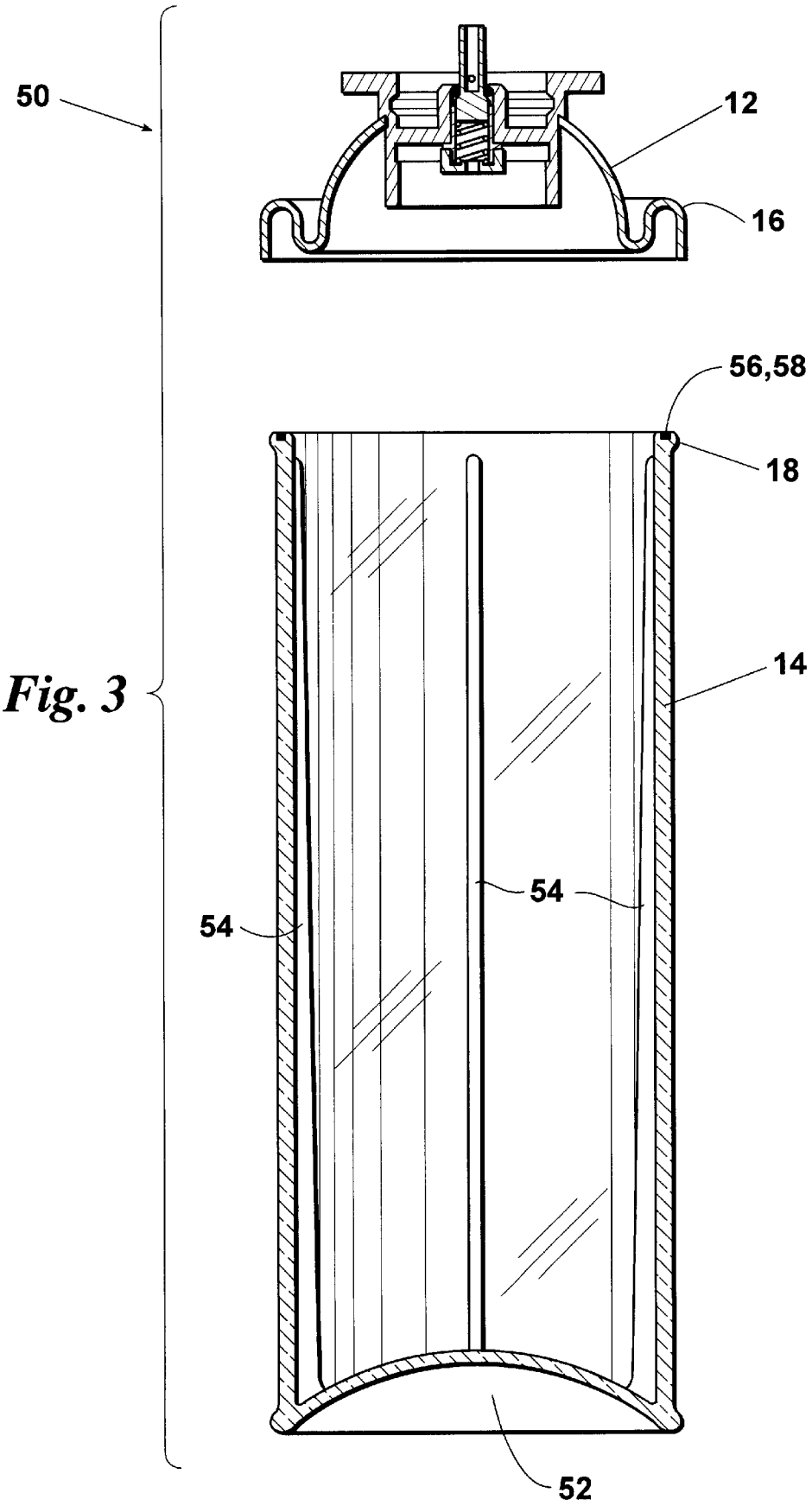
FIG. 3 provides an exploded, cutaway, elevational side view of a second embodiment 50 of the inventive container.

As illustrated in FIG. 3, a metal dome 12 can be secured on a transparent body 14 by crimping an outer flange 16 of the dome over an exterior lip 18 formed around the upper end of body 14. In order to prevent leakage, an elastomeric seal 56 or other gas-tight sealing element is preferably provided in a groove 58 formed in and around the upper edge of body 14. Seal 56 seals against the flange 16 of dome 12.

Plastic dome and bottom pieces can be attached to plastic body structures by: plastic welding techniques such as solvent, spin, vibration, or ultrasonic welding; adhesion; and other techniques commonly used for attaching plastic to plastic.

The top dome 6 and bottom piece 8 of inventive container 2 can be of generally any configuration used heretofore for camp-type fuel containers. As will be understood by those skilled in the art, the particular top dome structure depicted in FIGS. 1 and 2 is the same as that used heretofore for many camp-type butane canisters. Top dome 6 holds a camp-type butane discharge fitting comprising an outer radial flange 22 configured for attachment to typical camp-type butane appliances. Discharge fitting 20 also includes a spring-loaded valve assembly 24 having a valve stem 26 which projects from the top of fitting 20. Spring 28 continuously urges valve stem 26 outward, thereby closing the valve. However, when discharge fitting 20 is attached to the inlet fitting of a butane appliance, such attachment will automatically push and hold valve stem 26 inward such that the valve is open.

Although inventive container 2 has been illustrated as having a top dome 6 and discharge fitting 20 of the type commonly employed for camp-type butane containers, it will be understood that a propane fitting or any other type of camp-type fitting employed in the art can be used in the inventive container.

A second embodiment 50 of the inventive container is depicted in FIG. 3. Inventive container 50 is a two-piece design wherein the bottom piece 52 is co-molded with and formed of the same material as body 14, thus forming a unitary, transparent body and bottom structure. The unitary body structure also includes elongate longitudinal interior ribs 54.

Figure 4:
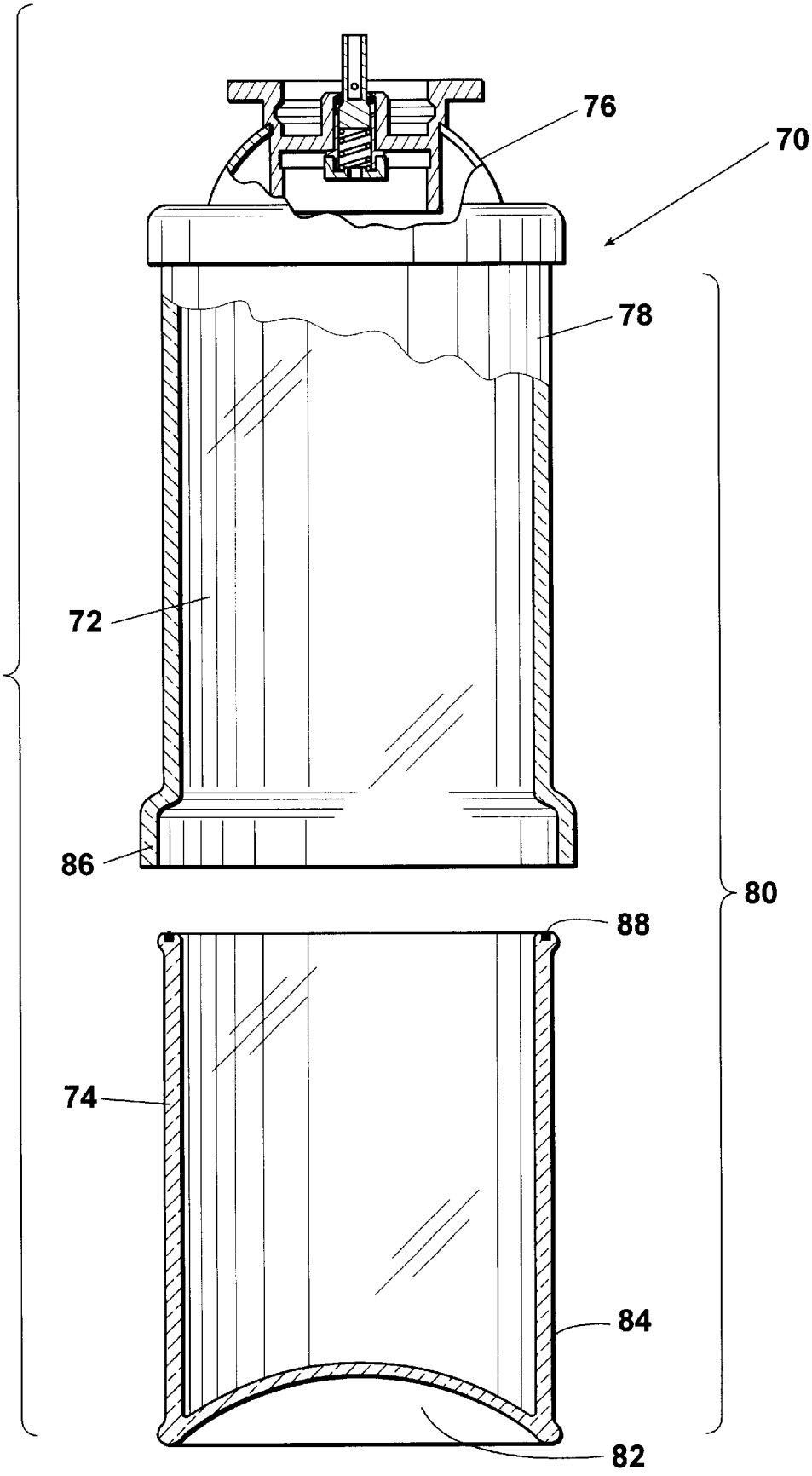
FIG. 4 provides an exploded, elevational side view of a third embodiment 70 of the inventive container.

Another two-piece embodiment 70 of the inventive container is depicted in FIG. 4. Inventive container 70 comprises a transparent, unitary upper piece 72 which is attached to a transparent, unitary lower piece 74. Each of the unitary pieces 72 and 74 can be formed, for example, by injection molding. Unitary upper piece 72 includes a top dome 76 which is formed on an upper portion 78 of the container body 80. The lower piece 74 includes a concave bottom end 82 which is formed on a lower portion 84 of container body 80. A flange 86 is provided on the lower end of upper piece 72 for positioning around the upper end of lower piece 74. Upper piece 72 is attachable to lower piece 74 using any of the plastic to plastic attachment techniques mentioned above. In order to prevent leakage, an elastomeric seal 88 or other gas-tight sealing element can be provided on lower piece 74 or within upper piece 72 for sealing the attachment of the lower and upper pieces.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A camping-type container for a liquified gas fuel, said liquified gas fuel having a liquid level in said container, said container comprising:

a container body formed of a transparent material such that a user can see said liquid level in said container;

a top end structure on a top end of said container body; and a discharge valve provided in said top end structure, said discharge valve being a valve of a type attachable to a camping-type appliance.

2. The container of claim 1 wherein said top end structure is a metal structure secured on said top end of said body structure.

3. The container of claim 1 wherein said top end structure is formed of a transparent material.

4. The container of claim 3 wherein said top end structure is molded onto said top end of said body structure.

5. The container of claim 3 wherein said top end structure is secured on said top end of said body structure by plastic welding.

6. The container of claim 1 further comprising a metal bottom end structure secured on a bottom end of said container body.

7. The container of claim 1 further comprising a transparent bottom end structure on a bottom end of said container body.

8. The container of claim 7 wherein said bottom end structure is molded onto said bottom end of said body structure.

9. The container of claim 7 wherein said bottom end structure is secured on said bottom end of said body structure by plastic welding.

10. The container of claim 1 wherein said discharge valve is a spring-loaded butane discharge valve.

11. The container of claim 1 wherein said container body comprises an upper transparent body portion attached to a lower transparent body portion.

12. The container of claim 11 wherein said upper body portion is attached to said lower body portion by plastic welding.

13. The container of claim 1 wherein said top end structure is a dome structure.

14. The container of claim 1 wherein said container is formed of a transparent material from the group consisting of:

acrylonitrile butadiene styrene; and cellulose acetate butyrate.

15. The container of claim 14 wherein said container is formed of acrylonitrile butadiene styrene.

16. The container of claim 14 wherein said container is formed of cellulose acetate butyrate.

* * * * *